United States Patent [19]

Shibata et al.

[11] 4,392,790

[45] Jul. 12, 1983

[54] COUPLING SYSTEM FOR SUBMERGIBLE PUMP

[75] Inventors: Tomoyuki Shibata, Yokohama; Mituhito Nakayama; Kiyoshi Ouchi, both of Fujisawa, all of Japan

[73] Assignee: Ebara Corporation, Tokyo, Japan

[21] Appl. No.: 162,646

[22] Filed: Jun. 24, 1980

[51] Int. Cl.[3] ..... F04B 47/00; F16L 27/08

[52] U.S. Cl. ..... 417/360; 417/361; 285/24; 285/325

[58] Field of Search ..... 417/360, 361; 285/24, 285/27, 67, 325; 222/385

[56] References Cited

U.S. PATENT DOCUMENTS

| | | | |
|---|---|---|---|
| 3,018,925 | 1/1962 | Englesson | 417/360 |
| 3,365,215 | 1/1968 | Arzt | 285/325 |
| 3,427,982 | 2/1969 | Englesson | 222/180 |
| 3,515,495 | 6/1970 | Blum | 417/360 |
| 3,656,871 | 4/1972 | Carlsson | 417/360 |
| 3,667,715 | 6/1972 | Mertens | 222/385 |
| 3,771,914 | 11/1973 | Crespo | 417/360 |
| 3,810,718 | 5/1974 | Blum | 417/360 |
| 3,851,898 | 12/1974 | Ihara | 417/360 |
| 3,861,834 | 1/1975 | Blum | 417/360 |
| 3,880,553 | 4/1975 | Wolflord | 417/360 |
| 4,060,345 | 11/1977 | Blum | 417/360 |

FOREIGN PATENT DOCUMENTS

| | | | |
|---|---|---|---|
| 1231562 | 12/1966 | Fed. Rep. of Germany | 417/360 |
| 2139654 | 2/1973 | Fed. Rep. of Germany | 417/360 |
| 51-107602 | 3/1976 | Japan . | |
| 52-134101 | 3/1977 | Japan . | |

*Primary Examiner*—William R. Cline
*Assistant Examiner*—John M. Kramer
*Attorney, Agent, or Firm*—Oblon, Fisher, Spivak, McClelland & Maier

[57] ABSTRACT

A coupling system for detachably coupling an outlet port of a submergible pump to an inlet port of a discharge conduit is constructed by a single guide rail having at least two, and preferably, two guide portions extending along the length thereof, the rail being fixed at its lower end to the conduit; an arm attached to the pump so that it is guided by the rail; and first and second engaging means provided in the discharge conduit adjacent the inlet port and in the arm respectively so that the pump is held stationary when the pump is lowered and both the engaging means engage with each other. The whole system is made compact by arranging the orientation of the guide rail particularly when it is made of an angle bar. Also, further consideration is given to effect a line contact between the first and second engaging means to reduce the severe manufacturing tolerance necessary to achieve a satisfactory coupling between the inlet and outlet ports.

3 Claims, 8 Drawing Figures

COUPLING SYSTEM FOR SUBMERGIBLE PUMP

FIELD OF INVENTION

The present invention relates to a submergible pump and more particularly to a detachable coupling system for the submergible pump adapted to be coupled to and decoupled from a discharge conduit immersed in a liquid or water.

BACKGROUND OF INVENTION

It has been proposed to provide a detachable coupling system to such a submergible pump of the type above so as to effect coupling and decoupling without need of access by an operator to the place where the conduit and the pump is coupled. Such coupling system is desired because the submergible pump may be immersed in filthy water or sewage for discharging the same through the conduit. (Decoupling operation of such pump is required, for example, to perform inspection and maintenance of the pump.) Further, in case of filthy water or sewage, even should the operator have access to the pump, the opacity or turbidity of the filthy water would prevent him from observing the coupling portion. Thus, such submergible pump having such a detachable coupling system as above has been simply lowered into or lifted from the water by an operator standing at the place above the surface of the water. Most of the detachable coupling system of the above type rely substantially on the weight of the pump for mating a discharge port of the pump to an inlet end of the discharge conduit with the pump being hung by a rope or chain so that the weight of the pump urges the pump toward the inlet end of the conduit.

For accomplishing the above matter, there have been proposed several approaches, for example, as disclosed in U.S. Pat. Nos. 3,861,834; 3,880,553; 4,060,345; 3,427,982; 3,018,925; Japanese Utility Model Public Disclosure No. 134101/78 and Japanese Patent Public Disclosure No. 107602/77.

In the prior art noted above, a submergible pump is hung by a rope or chain to be lifted from and lowered into the water and means is generally provided to keep the pump properly orientated for assuring the proper coupling of the pump with the discharge conduit. Such means is usually a pair of guide rails or bars such as disclosed in U.S. Pat. Nos. 3,880,553; 3,427,982 and Japanese Patent Public Disclosure No. 107602/77. Such provision of two guide rails or bars is made to prevent the rotation of the pump during its descending as occurs if the guide is a single round rod. However, the provision of such two guide rails increases the size of the plan view of the pump in combination with the guide rails (as viewed in a direction parallel to the guide rails) whereby it may become necessary to increase the size or diameter of a manhole in case the submergible pump is used in the manhole. Further, an element to be attached to the pump housing for guiding the pump along the guide rails also becomes large. Such increase in size makes the pump inconvenient to handle and, also, increases the manufacturing cost. In contrast to the above, there is another approach such as disclosed in U.S. Pat. Nos. 3,861,834 and 4,060,345 wherein an aligning rail is attached to the pipe guide (which serves as a discharge conduit also) to assist the proper orientation of the pump just before coupling is effected. Since the aligning rail is attached at the lower part of the guide, there still remains a problem in that the pump rotates around the guide and some adjustment is required to align the pump side element with the aligning rail. This is troublesome and also may require stopping the descent of the pump temporarily and cause damage to the system.

Also, in the prior art, engaging means have been commonly employed to fasten or hold the pump to the stationary discharge conduit during the period that the two are mated and coupled so that the discharge port of the pump is maintained in place with sealing engagement with the inlet end of the discharge conduit. Usually the discharge port of the pump is provided with a flange and, similarly the inlet end of the conduit is provided with a flange so that the two flanges sealingly mate with each other when the pump is lowered into the water along the guide. The respective coupling means of the conduit and the pump are arranged so that they first contact each other during the descending of the pump and the coupling means attached to the pump further moves downwardly as the pump continues to descend until it finally rests at a position which is determined together with the opposite coupling means mounted on the stationary discharge conduit. When the coupling means attached to the pump reaches its final position, the flanges of both the pump and the discharge conduit are adapted to sealingly mate with each other due to a component force of the gravity which urges the pump flange against the flange of the discharge conduit. The conventional coupling means are a combination of a cam and a follower or followers, wedge shaped members or the like designed to prevent relative separation of the pump and conduit at the final (lowered) operative position of the pump. Therefore, the locations and accuracy of the coupling means relative to the flanges of the pump and the conduit are important, and the fabrication of those means has been relatively time consuming and expensive.

In Japanese Utility Model Public Disclosure No. 134101/78, a single guide bar is employed to solve some of the drawbacks of the prior art; however, this is not completely satisfactory since the guiding element attached to the pump side is made relatively large and requires complicated fabrication and machining necessitating that the pump be supported at a position relatively remote from the guide bar and there is possibility of leakage if the severe manufacturing tolerance thereof is not met.

Thus, there has long been a need for a submergible pump coupling system which is free from the drawbacks of the prior art.

SUMMARY OF INVENTION

Accordingly, it is an object of the present invention to provide a coupling system for easily and reliably effecting detachable coupling of a submergible pump to a stationary discharge conduit.

It is also an object of the present invention to make a more compact submergible pump coupling system.

It is still another object of the present invention to provide a coupling system for a submergible pump which can be manufactured economically.

According to the present invention, the objects above are accomplished with a system which employs a single guide member fixed to a stationary discharge conduit and a guide element attached to a submergible pump. The combination of this coupling system and the submergible pump is compact, and the design is adapted to be manufactured economically by reducing the number of portions requiring severe tolerance. The coupling system according to the present invention may employ engaging members in both the discharge conduit and pumps so that holding of the pump in sealing engagement with the stationary discharge conduit is effected by making a line contact between the engaging members of the pump side and the conduit side. The present invention and its objects above as well as the other objects and advantages will become more clear when the description of the preferred embodiments is reviewed referring to the accompanying drawings the brief description of which is given below.

DESCRIPTION OF PREFERRED EMBODIMENTS

Figure 1:
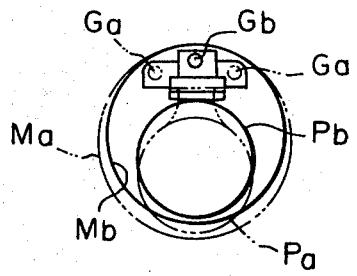
FIG. 1 is a schematic illustration showing the difference in size between the system according to the present invention using a single guide rail and that of the prior art using a pair of guide rails.

In FIG. 1, there is schematically illustrated a comparison of the sizes of a pump having a pair of guide means and one having a single guide means. This drawing shows, in plan view, a pump Pa (shown in phantom lines) accompanied by a pair of guides Ga and Ga and a pump Pb accompanied by a single guide means Gb. As is clear from FIG. 1, a circle Ma encompassing the pump Pa is larger than the other circle Mb encompassing the pump Pb since the guide Gb is positioned closer to the encompassing circle than the middle point of the two guides Ga, the circles Ma and Mb corresponding to the sizes required for manholes receiving the pumps Pa and Pb, respectively.

Figure 2:
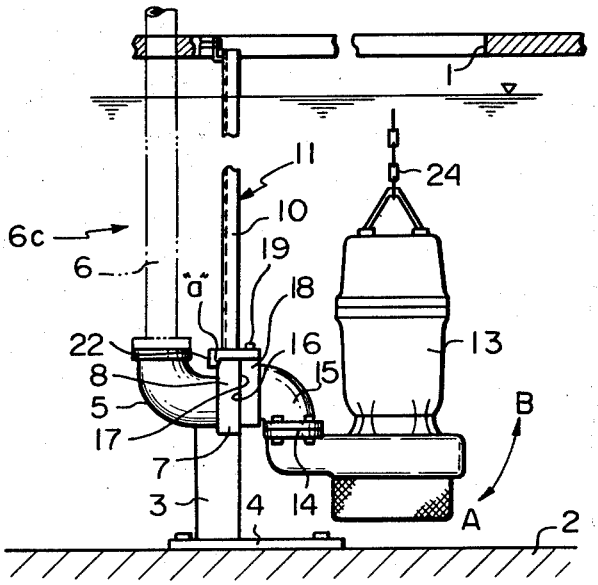
FIG. 2 is a side view of the coupling system according to the present invention shown with a submergible pump and the discharge conduit.

Referring now to FIG. 2, a preferred embodiment of the present invention is illustrated in which, below a manhole 1 and on a bottom surface 2 of the water, an anchoring or supporting column 3 is mounted on a base 4 which is secured to the bottom surface. An elbow 5 constituting a lower part of a discharge pipe is mounted on the column 3 and a discharge pipe 6 is connected to the elbow 5 at one end opening upwardly, the discharge pipe 6 extending upwardly so as to discharge the water outwardly and, thus, constituting a discharge conduit 6*c* together with the elbow 5.

Figure 3:
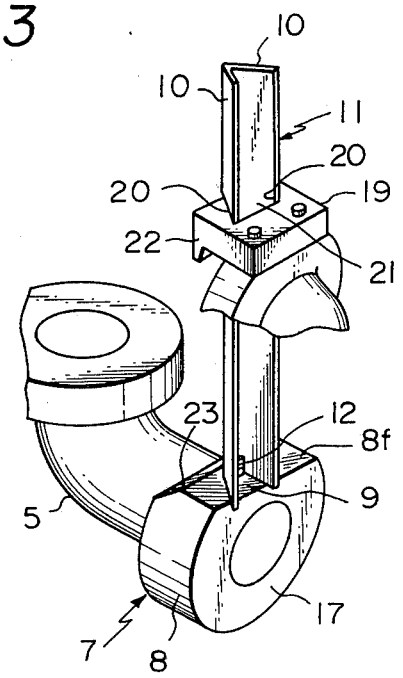
FIG. 3 is a perspective view of a portion of the system installed at the discharge conduit.

As shown in FIG. 3, a flange 8 is provided at the opposite end of elbow 5 opening in a horizontal direction. The upper portion of the flange is trimmed off to provide a horizontal flat surface 8*f* on which a recess 9 is formed to vertically receive the lower end of an elongated section member 11, such as an angle bar, having at least two flat guiding or sliding surfaces 10. The recess 9 is shaped to mate snugly with the section member or guide rail 11. The upper end of the guide rail 11 is arranged to terminate at the portion adjacent the inner surface of the manhole 1 and is fixed thereto and the lower end of the guide rail 11 is secured in place on the upper surface 8*f* of the flange 8 by engagement with the edges of the recesses 9 and a stud or bolt 12 which may determine the position of the section member or rail 11 against the edges of the recess 9.

According to the arrangement as explained above, the guide rail 11 may be simply secured in place by downwardly inserting it through the manhole 1 from the upper side thereof until the lower end of the guide rail 11 is fit between the edges of the recess 9 and the stud 12 and thence securing the upper end thereof to the inner surface of the manhole 1 or its associated elements with any suitable fastening means such as a bolt and a nut or screws.

On the other hand, a submergible water pump 13 is attached at its discharge port 14 with an elbow 15. The opposite end 16 of the elbow 15 is adapted to sealingly mate with an end surface 17 of the flange 8 at the end of the discharge conduit 6*c* when the pump 13 is lowered into the water so that the end 16 of the elbow 15 opposes the surface 17. The mating surface 16 is actually an end surface of a flange 18 at the end of the elbow 15 and the flange 18 is attached with an arm 19 at the upper portion thereof for the purposes explained hereunder. This arm 19 is provided with guide edges 20 formed in a notch 21 of the arm 19, the guide edges 20 serving to guide the pump 13 together with the elbow 15 along the guide rail 11 by slidably engaging the flat surfaces 10. By such sliding engagement between the guide edges 20 and the flat surfaces 10, the pump 13 is effectively prevented from being rotated horizontally or swung sidewardly during its descending and or ascending. The arm 19 is further provided with a pair of tapered projections 22, the tapered surfaces thereof facing downwardly so as to mate a canted surface 23 formed on the upper portion of the flange 8 of the elbow 5 when the pump 13 and its elbow 15 is lowered. By arrangement of the tapered projections 22 and the canted surface 23, the resting position or operating position of the pump 13 is determined. More specifically, when the submergible pump 13 hung by a rope or chain 24 is lowered through the manhole 1 and being guided by the guide rail 11, the tapered projections 22 first engage the canted surface 23 whereat the pump 13 is subjected to a rotational moment due to its self-weight tending to rotate the pump 13 in a direction "A" about a point "a" in FIG. 2 whereby the end surface 16 of the flange 18 seats against the end surface 17 of the flange to make communication between the pump 13 and the discharge conduit 6*c*.

Conversely, the pump 13 is slightly rotated at first in a direction B about the point "a" so as to separate the surface 16 from the surface 17 when the chain 24 is tensioned to commence the lifting of the pump, and thus, the pump 13 is smoothly lifted along the guide rail 11.

Figure 4:
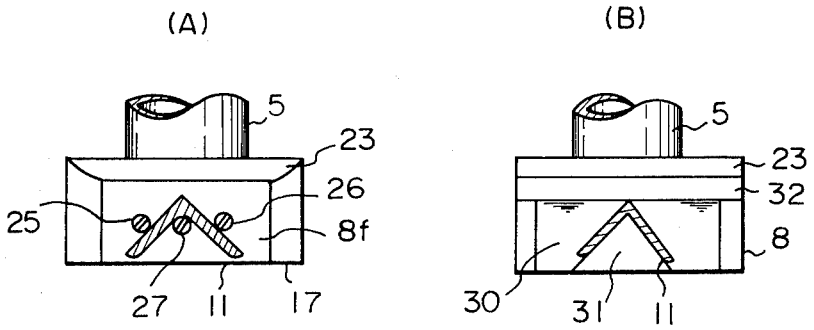
FIG. 4 is a plan view showing the modes of the installation of the guide rails other than that shown in Fig. 3.
Figure 5:
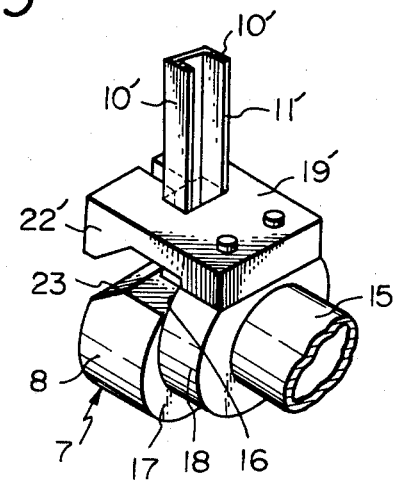
FIG. 5 shows another type of guide rail used in the present invention.

In FIGS. 4A and 4B, there are shown alternate ways for securing the lower end of the guide rail on the upper portion of the elbow flange 8. In FIG. 4A, three studs 25, 26 and 27 are mounted on the flat surface 8*f* so that they engage and position the guide rail 11 as illustrated. On the other hand, as shown in FIG. 4B, by trimming off a portion corresponding to a recess 30 at the upper portion of the flange 8 so that raised portions 31 and 32 remain, the lower end of the guide rail is snugly received in the recess 30. In the foregoing description and related drawings, the guide rail 11 has been explained to be made of an angle bar; however, the guide rail may be formed from an elongated section bar having a sectional shape other than "L" such as "H", "I", "T" or so on. For example, a guide rail 11' made of a channel bar is illustrated in FIG. 5 wherein an arm 19' having tapered projections 22' is arranged to engage flat surfaces 10' of the rail 11'.

Figure 6:
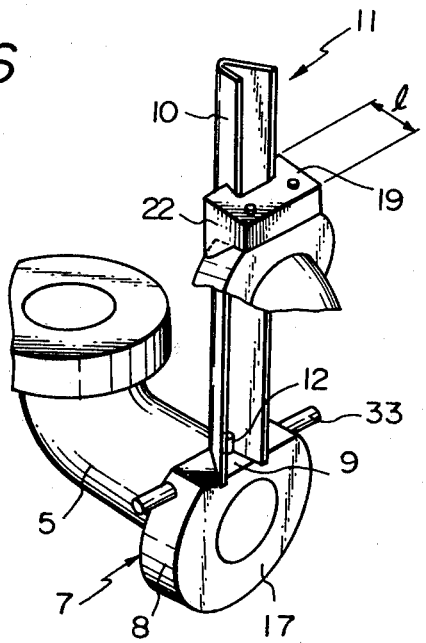
FIG. 6 is a perspective view corresponding to that shown in FIG. 3 but shows another embodiment of the present invention.
Figure 7:
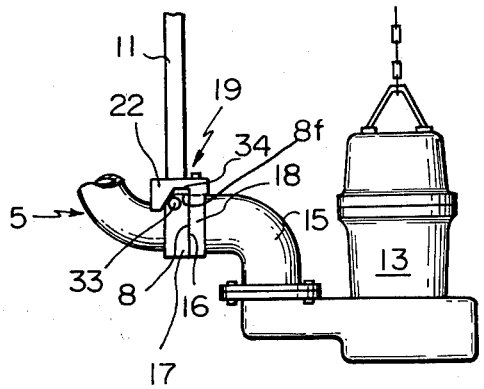
FIG. 7 is a side view of the system shown in FIG. 6.

In FIGS. 6 and 7, a further modified form of the coupling system according to the present invention is illustrated. In this embodiment, a pair of cylindrical rods 33 are horizontally mounted at the upper portion of the elbow flange 8 and at the opposite side portions of the rail 11, respectively. The rods 33 may be made as a single member horizontally extending through the flange 8. As shown, there is not provided a canted surface similar to the surface 23 shown in FIGS. 3, 4A, 4B and 5 since the rods 33 serve to engage the projections or hooks 22 in a manner similar to that of the canted surface 23 with further advantages. As touched upon earlier in the preamble of this specification, the relative configurations and positions of the mating end surfaces 16 and 17, tapered projections 22 and the canted surface must meet severe requirements as to their relationship to attain desired sealing effect at the mating surfaces in those embodiments illustrated in FIGS. 2, 3, 4A, 4B and 5. Otherwise there would be possibility that good sealing effect may not be expected thereby causing leakage at the portion of the mating surfaces. If the leakage is too much, the mating surfaces suffer erosion. In the embodiment shown in FIG. 6 the critical requirements in fabrication or machining and assembly of the elements concerned are remarkably reduced. In FIG. 7, the pump 13 is in operative position—that is, both end surfaces 16 and 17 of the respective flanges 18 and 8 are mated together to provide communication between the elbow 5 of the discharge conduit 6c and the pump 13. As seen from FIG. 7, the lower surface 34 of the arm 19 is not engaging with the rod 33 and the tapered surface of the projection or hook 22 engages the rod with a line contact therebetween. This construction permits the coupling operation to engage both end surfaces 16 and 17 first and thereafter the engagement of the hooks 22 with the rods 33 or vice-versa. After the line contact is established between the hooks 22 and the rods 33, the pump 13 may pivot or slightly rotate about the contact line thereby ensuring a good sealing effect between the end surfaces 16 and 17. On the other hand, the engagement of the hooks 22 with the rods is easily and smoothly relieved when the lifting operation of the pump is commenced. Although the hooks 22 have been illustrated and explained to have tapered flat surfaces, they may be made to have any other curved surfaces provided that they effect the line contact with the rods 33. Also, the rods 33 need not necessarily be cylindrical as far as they at least have portions which provide the line contact with the surfaces of the hooks 22.

Figure 8:
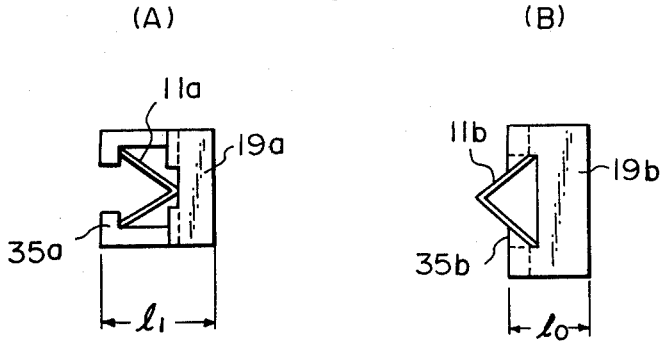
FIG. 8 is a comparison between the modes of the installation of the guide rail.

In FIG. 8, there is schematically shown a way to reduce the dimension of the coupling system. In FIG. 6, a dimension of the arm is referenced as "l". It is preferable to reduce this dimension so as to make the entire pump and coupling system, as viewed in a plan, more compact. When the angle bar guide rail is employed, typical orientations of the guide rail might be considered as illustrated in FIGS. 8A and 8B as viewed from upside of the manhole, the pump 13 being omitted but positioned at the righthand of the drawings, respectively. As is clear from the illustrations, "$l_0$" in FIG. 8B is shorter than "$l_1$" in FIG. 8A. Further, the arm **19*a* is guided at three portions while the arm 19*b* is guided by two portions. Accordingly, the arrangement shown in FIG. 8B is preferred wherein the apex line of the angle bar for the guide rail 11*b* is positioned remote from the pump in contrast to the arrangement shown in FIG. 8A**.

Also, as observed from FIGS. 8A and 8B, arms **19*a* and 19*b* are provided with a pair of arresting portions 35*a* or 35*b***, respectively which is adapted to provide guide edges in the arm as well as to prevent the pump from being swung laterally so that the pump becomes unguided by the rail.

The present invention has been explained in detail referring to the particular embodiments thereof. However, it should be noted that modification and change thereof are readily available to those skilled in the art within the spirit and scope of the present invention which is defined in the claims appended hereto.

What is claimed is:

1. A coupling system for detachably coupling a submergible pump to the lower end of a discharge conduit disposed in water, said system comprising:

a first flange attached to the lower end of said conduit held stationary relative to the bottom of the water, the flange having a first mating surface and a pair of cylindrical rods provided on said first flange relative to said first mating surface and extending horizontally from said first flange in opposite directions, respectively;

a second flange attached to the discharge end of said pump and having a second mating surface;

a single guide rail formed of an angle bar extending vertically and secured at its lower end to said first flange, said rail being provided with two planar sliding portions meeting at an apex line at the outwardly facing surfaces along the length thereof, said apex line being on a side of said rail opposite said pump;

an arm attached to said second flange and including a pair of hook members extending beyond and relative to said second mating surface from the pump side, and a guide means formed on said arm and matable with said two portions of said guide rail so as to be guided by said rail during descending and ascending of said pump, each of said pair of hook members having a downwardly extending tapered surface, wherein, during descending of said pump, each of said tapered surfaces engages one of said pair of rods with a line contact therebetween, said rods and tapered surfaces being constructed such that said rods remain in contact with said tapered surfaces upon the mating of said first and second mating surfaces, wherein said guide means do not extend to said apex line when said arm and rail are operatively engaged.

2. A coupling system as claimed in claim 1 wherein said guide rail is secured to said first flange in a recess formed in the upper portion of said first flange so as to snugly receive the lower end of said guide rail.

3. A coupling system as claimed in claim 1 wherein said guide rail is secured to said first flange by plural studs arranged to snugly receive the lower end of said guide rail.

* * * * *